United States Patent [19]

Wheeler et al.

[11] Patent Number: 4,947,658

[45] Date of Patent: Aug. 14, 1990

[54] SHIPPING CONTAINER

[75] Inventors: Warren J. Wheeler, Seattle; James C. Lutz, Hilliard; Jeffrey F. Delys, Edmonds, all of Wash.

[73] Assignee: NeoRx Corporation, Seattle, Wash.

[21] Appl. No.: 397,007

[22] Filed: Aug. 22, 1989

[51] Int. Cl.[5] ..... F25D 3/08

[52] U.S. Cl. ..... 62/372; 62/384; 62/457.2; 62/457.5; 62/547.9

[58] Field of Search ..... 62/384, 457.2, 457.5, 62/457.9, 372

[56] References Cited

U.S. PATENT DOCUMENTS

| | | | |
|---|---|---|---|
| 2,269,174 | 1/1942 | Birdsall | 62/384 X |
| 2,467,268 | 4/1949 | Merkle | 62/372 |
| 2,631,439 | 3/1953 | Feigenbaum | 62/372 |
| 2,781,643 | 2/1957 | Fairweather | 62/372 |
| 4,262,494 | 4/1981 | Karow, Jr. | 62/384 |
| 4,576,017 | 3/1986 | Combs | 62/372 |
| 4,898,294 | 2/1990 | Jennings | 62/384 X |

*Primary Examiner*—Lloyd L. King
*Attorney, Agent, or Firm*—Seed and Berry

[57] ABSTRACT

A shipping container for shipping both a set of vessels to be maintained in a frozen state and a set of vessels to be maintained in an unfrozen state during shipment, using a single supply of pre-frozen refrigerant material. The container includes an insulated chest and three trays removably positioned within the chest. The chest has a refrigerant well with one tray positioned immediately adjacent to the well and containing the vessels to be maintained frozen. The two trays positioned away from the well contain the vessels to be maintained in an unfrozed, but yet refrigerated state. The shipping container further includes a storage member to hold items to be shipped with the vessels but not requiring freezing or refrigeration. The chest is sized to receive three kit containers which each contain three trays and a storage member, and the chest is closed with a removable insulated lid.

24 Claims, 2 Drawing Sheets

SHIPPING CONTAINER

TECHNICAL FIELD OF THE INVENTION

The present invention relates generally to shipping containers, and more particularly, to a shipping container for safely shipping vials, bottles and other vessels containing biologic materials and other chemicals which must be refrigerated or frozen during shipment.

BACKGROUND OF THE INVENTION

It is often necessary to ship biologic materials and other chemicals which must be refrigerated or frozen during shipment to preserve the materials from spoilage. Also, it is sometimes necessary to sell products in kit form which include a number of different biologic materials and chemicals, some of which must be frozen during shipment and others which must be refrigerated but cannot be frozen. While it is highly desirable to ship all contents of the kit together, in a pre-assembled kit, this has been difficult or impossible when some materials must be frozen and other materials which must be refrigerated within a certain temperature range, but cannot be frozen during shipment.

It is also desirable to ship certain other materials such as written instructions with the kit, and to provide a shipping container for the kit which is lightweight, inexpensive, compact and easy to construct. Further, it is desirable to have a shipping container which can be used to ship several kits at one time, and when the shipping container is received, to permit the kits to be separately removed for subsequent storage. The packaging for the kits should be such that the vessels and other components included in a single kit are organized, shipped and subsequently stored together as a complete kit. This avoids the need for the person to whom the materials are shipped to maintain an inventory of the many components included in the kit, and reduces the chance of loss, breakage and incorrect or incomplete assembly of kit components from the inventory.

It will be appreciated that there has been a significant need for a shipping container for shipping a plurality of kits of materials, each containing vessels maintained in a frozen state and other vessels maintained in an unfrozen state during shipment. Preferably, each of the kits should be packaged as a unit within the shipping container and be removable as a unit for subsequent storage. The shipping container should allow shipment of the kit components assembled in kit form by the manufacturer, and subsequent storage of the kit components in the kit packaging without disassembly of the kit. The present invention fulfills these needs, and further provides other related advantages.

SUMMARY OF THE INVENTION

The present invention resides in a shipping container for safely shipping vials, bottles and other vessels of material with at least a first vessel to be maintained in a frozen state and at least a second vessel to be maintained in an unfrozen state during the shipment using a pre-frozen refrigerant material. The kit includes an insulated chest with four sidewalls and a bottom end wall of insulating material which define a closable interior space with an open top. The chest interior space has a central compartment and a refrigerant well immediately below the central compartment. The refrigerant well is sized to receive a predetermined amount of the pre-frozen refrigerant material therein sufficient to maintain the first vessel in a frozen state for a selected shipment duration. The chest has a tray support within the chest interior space positioned at about the interface between the refrigerant well and the central compartment. In a preferred embodiment of the invention, the tray support is a shoulder formed around the perimeter of an upper end of the refrigerant well.

The shipping container includes one or more kits which are shipped within the chest. In the preferred embodiment, the shipping container is sized to receive three kits within the chest central compartment. Each kit includes at least a first tray and a second tray. The first tray is removably positioned within the chest central compartment and has lower and upper faces and a wall of insulating material therebetween. The first tray is supported by the tray support to position the lower first tray face at the interface, immediately above the refrigerant well and the pre-frozen refrigerant material received therein. The tray support maintains the first tray at a fixed position against downward travel toward the refrigerant well during shipment even should the pre-frozen refrigerant material melt, sublime or otherwise change state or shape as heat is absorbed. The first tray upper face supports the first vessel at a fixed distance above the refrigerant well.

The first tray wall has a thickness of insulating material sized to permit sufficient heat transfer to maintain the first vessel in a frozen state during the entire selected shipment duration, but to sufficiently limit heat transfer during the selected shipment duration to approximately only that needed to maintain the first vessel in the frozen state during the selected shipment duration so as to prolong the refrigerant action of the pre-frozen refrigerant material and minimize the refrigerant material needed.

The second tray is also removably positioned within the chest central compartment, and has lower and upper faces and a wall of insulating material therebetween. The second tray operatively engages and is supported by the first tray above the first tray in fixed position against downward travel within the chest central compartment during shipment. Similarly, the second tray operatively engages and holds the first tray in fixed position against upward travel within the chest central compartment during shipment. The second tray lower face is held in juxtaposition with the first tray upper face. The second tray upper face supports the second vessel at a fixed distance above the refrigerant well.

The second tray wall has a thickness of insulating material sized to sufficiently limit heat transfer to maintain the second vessel in an unfrozen state during the selected shipment duration, but to permit sufficient heat transfer to maintain the second vessel in a refrigerated state within a desired limited range of temperatures during the selected shipment duration.

The container also includes an insulated lid removably positionable to close the chest open end and thereby close the chest interior space. The lid operatively engages and holds the second tray in fixed position against upward travel within the chest central compartment during shipment. With the shipping container of the present invention, the first and second vessels are packed within the same shipping container, with the first vessel maintained in a frozen state and the second vessel maintained in an unfrozen state during shipment using a predetermined amount of pre-frozen refrigerant material. The first and second vessels are held in stationary position within the chest even though the refrigerant material may change shape or size within the refrigerant well. This is accomplished using a lightweight, inexpensive, compact and easy to construct shipping container.

The shipping container can be provided with a central compartment sized to hold two or more kits positioned in side-by-side relation, one adjacent to the other, with a refrigerant well immediately below each of the kits. In such fashion, a plurality of kits can be shipped in the same shipping container. Further, each of the kits can be assembled by the manufacturer and removed from the chest as separate units for subsequent storage without requiring assembly of the kit components by the customer.

In a preferred embodiment of the invention, the shipping container is designed for shipping at least a third vessel which is maintained in an unfrozen but refrigerated state during shipment, at a higher refrigerated temperature than the second vessel. This is accomplished by using a third tray removably positioned within the chest central compartment between the second tray and the chest lid. The third tray has lower and upper faces and a wall of insulating material therebetween. The third tray operatively engages and is supported by the second tray about the first tray in fixed position against downward travel within the chest central compartment during shipment. Additionally, the third tray operatively engages the chest lid with the chest lid applying force to the second tray through the third tray to hold the first and second trays in fixed position against upward travel within the chest central compartment during shipment.

The third tray lower face is held in juxtaposition with the second tray upper face. The third tray upper face supports the third vessel at a fixed distance above the refrigerant well. The third tray wall has a thickness of insulating material sized to sufficiently limit heat transfer to maintain the third vessel in an unfrozen state during the selected shipment duration, but to permit sufficient heat transfer to maintain the third vessel in a refrigerated state within the desired range of temperatures during the selected shipment duration.

The shipping container may also contain a storage member removably positioned within the chest central compartment between the chest lid and the second tray, as will be described here, or between the chest lid and the third tray, if used. The storage member has a lower portion operatively engaging the second tray and an upper portion operatively engaging the chest lid with the chest lid applying force to the second tray through the storage member to hold the first and second trays in fixed position against upward travel within the chest central compartment during shipping. The storage member has four sidewalls and an end wall defining a closable, dry interior space with an open end. The storage member interior space is sized to receive written instruction materials or other items to be shipped with the first and second vessels but not requiring freezing or refrigeration. The storage member includes a storage member closure removably positionable to close the storage member open end and thereby close the storage member interior space.

When used to ship fewer than the kits for which the chest central compartment is sized, the shipping container is provided with a block of insulating material sized substantially equal to one of the kit containers for substitution therefor in the chest central compartment. The block prevents significant heat loss through the space in the chest central compartment provided for the missing kit container, and also prevents movement of the other kit containers about within the chest central compartment during shipment.

Other features and advantages of the invention will become apparent from the following, more detailed description, taken in conjunction with the accompanying drawings.

BEST MODE FOR CARRYING OUT THE INVENTION

Figure 1:
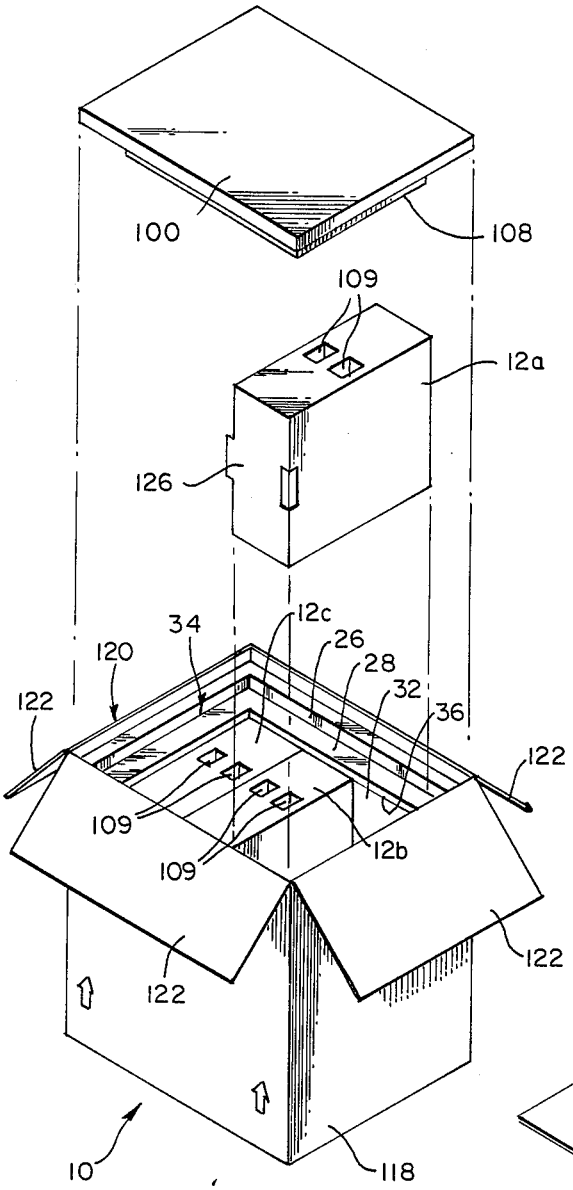
FIG. 1 is a perspective view showing the shipping container of the present invention with two kit containers positioned within the central compartment of a chest and one kit container removed, with the chest lid shown removed.

As shown in the drawings for purposes of illustration, the present invention is embodied in a shipping container, indicated generally by reference numeral 10. The shipping container includes three kit containers **12*a*, 12*b*, and 12*c*, as best shown in FIG. 1**. In the presently preferred embodiment of the invention, the shipping container is sized for three kit containers, but the shipping container can be designed to hold fewer or more shipping containers, as desired.

Figure 3:
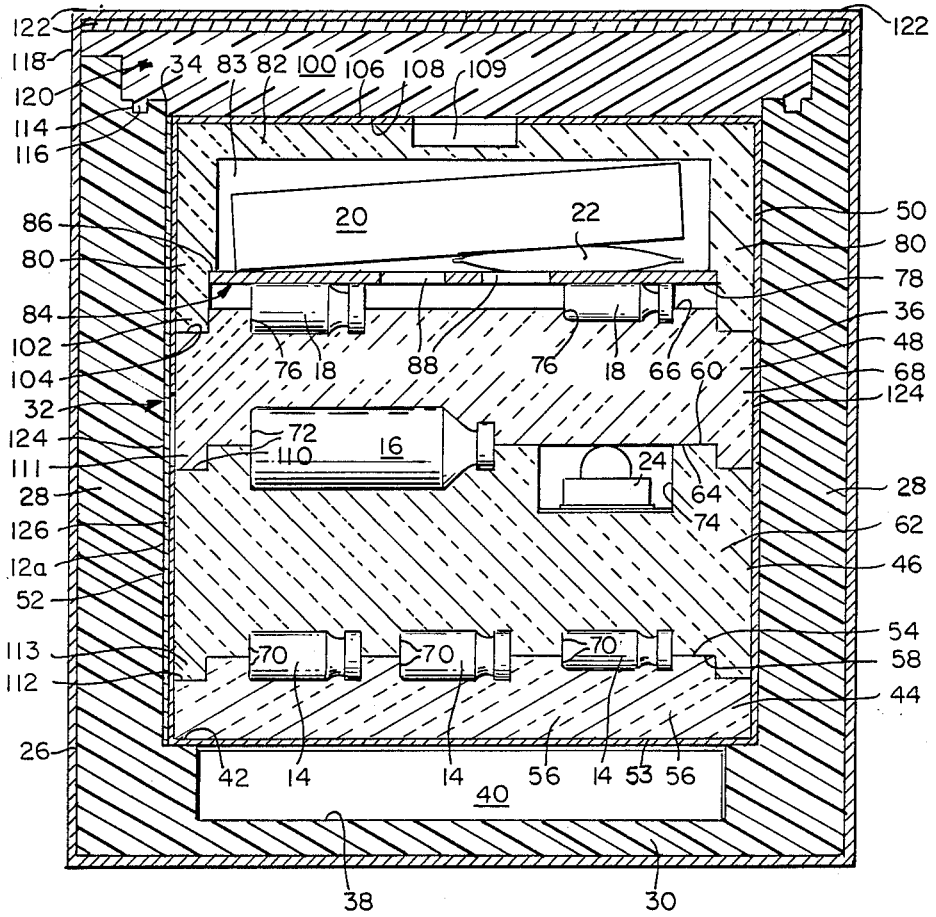
FIG. 3 is an enlarged cross-sectional elevational view of the shipping container of FIG. 1 showing the kit containers positioned within the chest central compartment with the chest shipping box closed.

As best shown in FIG. 3 for shipping container **12*a*, each of the shipping containers carries a plurality of first vessels 14 containing material to be maintained in a frozen state during shipment. The shipping container 12*a* further carries at least a second vessel 16 to be maintained in an unfrozen, but yet refrigerated, state during shipment. The shipping container 12*a* also carries a plurality of third vessels 18 to be maintained in an unfrozen, but refrigerated state during shipment. The shipping container 12*a* also carries numerous items to be shipped with the first, second and third vessels 14, 16 and 18, but not requiring freezing or refrigeration, such as written instruction materials 20, labels 22 and a filter 24**.

The shipping container 10 includes an insulated chest 26 with four sidewalls 28 and a bottom end wall 30 comprised of insulating material and defining a closable interior space 32 with an open top 34. The chest interior space 32 has a central compartment 36 and a refrigerated well 38 immediately below the central compartment. The refrigerated well 38 is sized to receive a predetermined amount of a prefrozen refrigerant material 40 sufficient to maintain the first vessels 14 in a frozen state for a selected shipment duration. The prefrozen refrigerant material 40 may be dry ice in slabbed or pellet form or a cold pack of conventional material.

It is noted that the refrigerant material 40 must be selected so that it has a volume which can fit fully within the refrigerant well 38, and has a sufficient cooling capacity to maintain the first vessels 14 in a frozen state (i.e., 0° C. or below) during the entire shipment duration. Presently, the selected shipment duration is 72 hours, which is calculated to allow shipment of the shipping container 10 to most customers using available modes of transportation. A five to eight pound slab of dry ice is presently preferred.

The chest 26 further includes a tray support in the form of a shoulder 42 which extends around the perimeter of an upper end of the refrigerant well 38 to provide an upward facing tray support wall projecting laterally outward beyond the refrigerant well. The shoulder 42 defines an interface between the refrigerant well 38 and the chest central compartment 36.

As shown in FIG. 3 for shipping container 12*a*, each of the shipping containers includes a first tray 44, a second tray 46, a third tray 48 and a storage member 50, which are packed together in a carton 52 as a unit to comprise one complete kit. While the three kit containers 12*a–c* are shipped together, each is separately removable from the chest 26 for subsequent storage apart from the chest as a complete kit with all components having been assembled by the manufacturer and ready for use by the customer. This avoids the customer being required to organize and store components and then assemble them when it is necessary to use a kit for the diagnosis or other procedure to be conducted with the kit. The customer does not have to store an assortment of vessels containing a variety of materials, and does not have to be concerned about possible loss or breakage of vessels or the incorrect or incomplete assembly of kits. When the kit container 12*a* is removed from the chest 26, it continues to serve as a compact, protective housing for the contents of the kit, and the chest 26 and the refrigerant material 40 may be thrown away or recycled.

The first tray 44, second tray 46, third tray 48, and storage member 50 packaged within the kit carton 52 are removably positioned in the chest central compartment 36. The first tray 44 has a lower face 53 and an upper face 54, with a wall 56 of insulating material therebetween. The first tray 44 is supported by the tray support shoulder 42 of the chest 26 to position the lower first tray face 53 immediately above the refrigerant well 38 and the pre-frozen refrigerant material 40 positioned therein. It is noted that the pre-frozen refrigerant material 40 is sized so that it is either spaced from the first tray lower face 53 or just touching the first tray lower face so that the prefrozen refrigerant material does not hold the first tray 44 from seating firmly against the shoulder 42. In such manner, the tray support shoulder 42 maintains the first tray 44 at a fixed position against downward travel toward the refrigerant well 38 during shipment even should the refrigerant material melt, sublime or otherwise change state, size or shape as heat is absorbed. With some prior art shipping containers, the contents being shipped rest directly upon the refrigerant, so as the material changes shape or size due to melting or sublimation, the contents being shipped become loose and shift around within the shipping container. This can lead to damage of the materials being shipped. With the present invention, the kit containers 12*a–c* are maintained in firm seated contact with the tray support shoulder 42 without relying upon the pre-frozen refrigerant material 40 to maintain the position of the kit containers within the chest 26.

The first tray upper face 54 supports the first vessels 14 at a fixed distance above the refrigerant well 38 since the kit containers 12*a–c* are prevented from moving by the tray support shoulder 42. As such, the first vessels 14 are maintained at a precise and constant distance above the refrigerant well 38 and the refrigerant material 40 therein during the entire shipment.

The first tray wall 56 has a thickness of insulating material sized to permit sufficient heat transfer therethrough to maintain the first vessels 14 in a frozen state during the selected shipment duration, but to sufficiently limit heat transfer to approximately only that needed to maintain the first vessels in the frozen state during the selected shipment duration. As such, the refrigerant action of the pre-frozen refrigerated material 40 is prolonged and the amount of refrigerant material needed to accomplish the desired freezing and refrigeration is minimized.

The second tray 46 is positioned above the first tray 44 and has a lower face 58 and an upper face 60, with a wall 62 of insulating material therebetween. The second tray lower face 58 engages and is in juxtaposition with the first tray upper face 54 to support the first tray 44 above the second tray 46 in fixed position against downward travel within the chest central compartment 36 during shipment. In like fashion, the second tray 46 holds the first tray 44 in fixed position against upward travel within the chest central compartment 36 during shipment.

The second tray upper face 60 supports the second vessel 16 at a fixed distance above the refrigerant well 38, and the second tray wall 62 has a thickness of insulating material sized to sufficiently limit heat transfer therethrough to maintain the second vessel in an unfrozen state during the selected shipment duration, but to permit sufficient heat transfer to maintain the second vessel in a refrigerated state within a desired limited range of temperatures. In the presently preferred embodiment of the invention, it is desirable to have the second vessels 16 maintained within the temperature range of 2° to 10° C. during the entire 72-hour selected shipment duration, but without the material in the second vessel becoming frozen.

The third tray 48 is positioned above the second tray 46 and has a lower face 64 and an upper face 66, with a wall 68 of insulating material therebetween. The third tray lower face 64 engages and is in juxtaposition with the second tray upper face 60 to support the third tray 48 above the second tray 46 in fixed position against downward travel within the chest central compartment 36 during shipment. In like fashion, the third tray 48 holds the second tray 46, and hence the first tray 44, in fixed position against upward travel within the chest central compartment 36 during shipment.

The third tray upper face 66 supports the third vessels 18 at a fixed distance above the refrigerant well 38, and the third tray wall 68 has a thickness of insulating material sized such that in combination with the first and second tray walls 62 and 68, heat transfer therethrough is sufficiently limited to maintain the third vessels 18 in an unfrozen state during the selected shipment duration, but sufficient heat transfer is permitted to maintain the third vessels in a refrigerated state within the desired range of temperatures during the selected shipment duration. In the presently preferred embodiment, the second vessel 16 is a saline solution which is less sensitive to freezing, and the third vessels 18 positioned farther from the refrigerant well 38 contain the materials which must not be frozen under any circumstances, but yet must be refrigerated within the desired range of temperatures during shipment.

To maintain the first, second and third vessels 14, 16 and 18 against lateral movement during shipment, the first tray upper face 54 and the second tray lower face 58 have correspondingly positioned indentations 70 therein which together define cavities sized to snugly receive the first vessels 14 therein. Similarly, the second tray upper face 60 and the third tray lower face 64 have correspondingly positioned indentations 72 therein which together define a cavity sized to snugly receive the second vessel 16 therein. An indentation 74 is also provided in the second tray upper face 60 to provide for storage of the filter 24. The third tray upper face 66 has indentations 76 therein sized to snugly receive the third vessels 18. As will be described in more detail below, a divider member 78 serves, at least in part, to maintain the third vessels 18 in the indentation 76 during shipment.

The last element comprising the kit container 12*a* is the storage member 50. The storage member 50 is defined by four sidewalls 80 and an upper end wall 82 to provide a closable, dry interior space 83 with an open end 84, closable by the divider member 78. The divider member 78 is held in position against upward travel by a perimeter shoulder 86 of the storage member 50 and is used to apply a downward force on the third vessels 18 to maintain them in their indentations 76 during shipment. Finger holes 88 are provided in the divider member 78 to facilitate its removal upon disassembly of the kit container 12*a* prior to use.

The interior space 83 of the storage member 50 provides a dry space sized to receive the written instruction materials 20 and the labels 20, or any other items desired to be shipped to the customer with the kit container 12*a*, but not requiring freezing or refrigeration.

The storage member 50 is positioned between the third tray 48 and an insulated chest lid 100. The storage member sidewalls 80 have as a lower perimeter portion 102 which engages a perimeter recess 104 in the third tray upper face 66. The storage member 50 also has an upper face 106 which engages and is in juxtaposition with a lower face 108 of the chest lid 100. With this arrangement, the chest lid 100 applies force to the first, second and third trays 44, 46 and 48 through the storage member 50 to hold all three trays in fixed position against upward travel within the chest central compartment 36 during shipment.

The storage member upper face 106 is provided with a pair of recesses 109, and corresponding cutouts are provided in the carton 52 so that a person may grasp the kit container 12*a* by insertion of his fingers into the recesses 109 to facilitate insertion of the kit container into and removal of the kit container from the chest 26.

The lower perimeter portion 102 of the storage member sidewalls 80 are sized and positioned to project into and fit snugly within the perimeter recess 104 of the third tray upper face 66 to provide an interference or friction fit, locking the storage member 50 and the third tray 48 together. Similarly, the second tray upper face 60 has a perimeter recess 110 and the third tray lower face 64 has a corresponding perimeter projection Ill sized and positioned to project into and fit snugly within the recess 110 to provide an interference fit locking the second and third trays 46 and 48 together. In identical fashion, the first tray upper face 54 has a perimeter recess 112 and the second tray lower face 58 has a corresponding perimeter projection 113 sized and positioned to project into and fit snugly within the recess 112 to provide an interference fit locking the first and second trays 44 and 46 together.

The chest lid 100 is removably positionable to close the chest open top 34 and thereby close the chest interior space 32. The chest lid 100 projects outward over the chest sidewalls 28, and an upper end of the chest sidewalls has a groove 114 formed therein and the chest lid has a downwardly projecting tongue 116 positioned to project into and fit snugly within the groove to provide not only a tight thermal seal but also to lock the chest lid 100 to the chest 26.

With the three kit containers 12*a–c* positioned within the chest central compartment 36, the predetermined amount of pre-frozen refrigerant material 40 positioned in the refrigerant well 38, and the chest lid 100 position closing the chest open top 34, the combination is placed in a corrugated shipper box 118 through an open end 120 of the box, as shown in FIG. 1. The shipper box 118 can be sealed by folding four box flaps 122 inward and using an appropriate adhesive or tape. When so sealed, the shipping container 10 is ready for shipment with the three kit containers 12*a–c* packed within the same chest 26 for shipment, with the first vessels 14 maintained in a frozen state and the second and third vessels 16 and 18 maintained in an unfrozen, yet refrigerated state by a single source of pre-frozen refrigerant material 40. The first, second and third vessels 14, 16 and 18 are held in stationary position within the chest 26 to minimize the chance of breakage even though the refrigerant material 40 changes shape or size within the refrigerant well as it melts or sublimes. In addition to providing the first, second and third tray walls 56, 62 and 68 with an appropriate thickness of insulating material to achieve the desired thermal conductivity, an insulating material is selected that also has sufficient shock-absorbing capability so as to minimize the chance of breaking the vessels as a result of the normal shocks encountered during shipment. In the presently preferred embodiment of the invention, a Styrofoam material is utilized.

It is important to eliminate any free space between the chest sidewalls 28 and the kit containers 12*a–c* so as to provide a thermal barrier to prevent any significant heat transfer between the first, second and third vessels 14, 16 and 18 and the refrigerated well 38 through the air space. To eliminate any such air space, the first, second and third trays 44, 46 and 48 each have four sidewalls 124 contiguous with the corresponding sidewalls of the adjacent trays, and the trays are sized in lateral dimension to fit snugly within the chest central compartment 36 with the tray sidewalls in engagement and juxtaposition with the corresponding chest sidewalls 28. This also prevents undesirable movement of the kit containers 12*a–c* within the chest central compartment 36 during shipment. To further control the heat transfer which takes place within the shipping container 10, the chest sidewalls 28 each have a thickness of insulating material sized to prevent any significant heat transfer between the first, second and third vessels 14, 16 and 18 and the refrigerant well 38 through the chest sidewalls.

Figure 2:
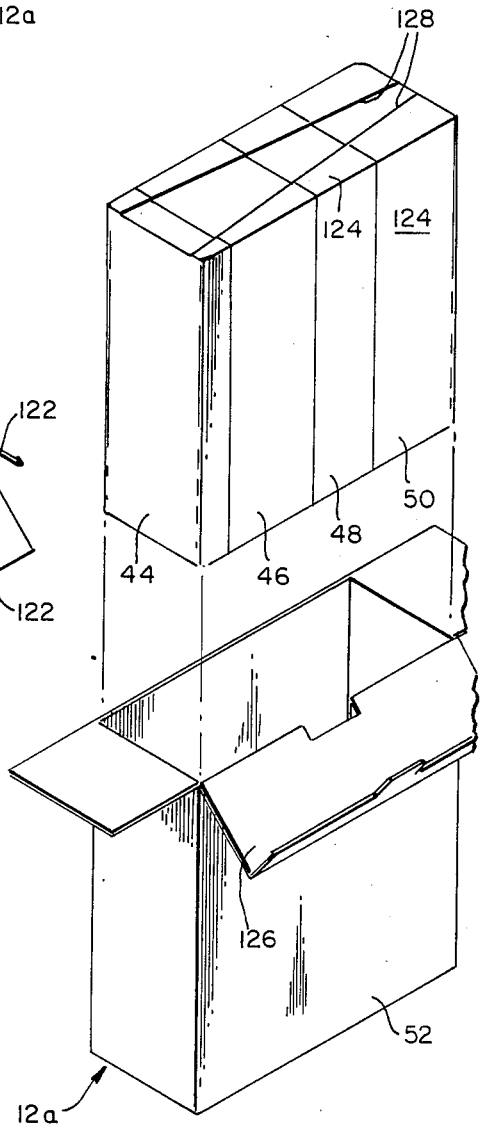
FIG. 2 is an enlarged perspective view of one of the three kit containers shown in FIG. 1 removed from the chest and rotated 90 degrees, with the packing material for the kit container shown removed from the carton for the kit container.

It is noted that when the kit container 12*a* is positioned within the chest 26, it is oriented as shown in FIG. 3 with a lid flap 126 for the carton 52 positioned to the left side. The carton lid 52 is shown positioned at the top of the kit container 12*a* when viewed in FIG. 2. It is further noted that when the kit container 12*a* is positioned within the chest 26 for shipment, the first, second and third vessels 14, 16 and 18 are oriented for travel on their side, but when the kit container is stored on the customer's shelf, it is intended to be rotated so as to orient the bottles in an upright position for storage. To facilitate proper orientation of the kit container 12*a*, two narrow sidewalls 124 have a pair of converging straight-line indentations 128 formed into the Styrofoam material used for the first, second and third trays 44, 46 and 48 and the storage member 50. The end of the kit container 12*a* toward which the indentations 128 converge indicates the end to be kept up during shipment.

Figure 4:
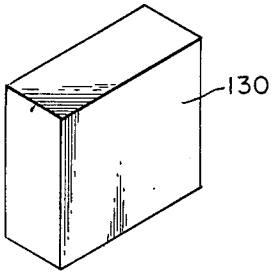
FIG. 4 is a perspective view of a block of insulating material used as substitution for one of the kit containers when less than three kit containers are to be shipped in the chest of FIG. 1.

While the shipping container 10 is designed with a chest 26 to hold three kit containers 12*a–c*, sometimes it is desirable to ship less than three kit containers to a customer using the same shipping container. Simply leaving an empty space within the chest 26 where the missing kit container would normally be would so alter the thermal characteristics of the shipping container that the first vessels 14 might not be maintained in a frozen state during the entire shipment, and the second and third vessels 16 and 18 might not be adequately refrigerated during the entire shipment, or possibly even frozen during part of the shipment. In order to maintain the thermal characteristics of the shipping container 10, even when shipped without one of the kit containers 12*a–c*, a block 130 of insulating material, as shown in FIG. 4, sized so as to be substantially equal to the outer dimensions of the kit container 12*a*, is provided for substitution therefor in the chest central compartment 36. This prevents significant heat transfer through the space in the chest central compartment 36 which would otherwise exist as a result of the missing kit container. The block 130 also prevents heat transfer between the vessels and the refrigerant well 38 through the sidewalls 28 of the chest 26. The block 130 also serves to prevent movement of the kit containers which are being shipped within the chest during shipment. In the presently preferred embodiment of the invention, a block of Styrofoam material is used.

It will be appreciated that, although a specific embodiment of the invention has been described herein for purposes of illustration, various modifications may be made without departing from the spirit and scope of the invention.

What is claimed is:

1. A shipping container for safely shipping vials, bottles and other vessels of material with at least a first vessel to be maintained in a frozen state and at least a second vessel to be maintained in an unfrozen state during shipment using a pre-frozen refrigerant material, comprising:

an insulated chest with four sidewalls and a bottom end wall of insulating material defining a closable interior space with an open top, said chest interior space having a central compartment and a refrigerant well immediately below said central compartment, said refrigerant well being sized to receive a predetermined amount of the pre-frozen refrigerant material therein sufficient to maintain the first vessel in a frozen state for a selected shipment duration, said chest having a tray support within said chest interior space positioned at about an interface between said refrigerant well and said central compartment;

a first tray removably positioned within said chest central compartment and having lower and upper faces and a wall of insulating material therebetween, said first tray being supported by said tray support to position said lower first tray face at said interface, immediately above said refrigerant well and the pre-frozen refrigerant material received therein, said tray support maintaining said first tray at a fixed position against downward travel toward said refrigerant well during shipment even should the pre-frozen refrigerant material melt, sublime or otherwise change state as heat is absorbed, and thereby change in shape or size, said first tray upper face supporting the first vessel at a fixed distance above said refrigerant well, said first tray wall having a thickness of insulating material sized to permit sufficient heat transfer therethrough to maintain the first vessel in a frozen state during said selected shipment duration, but to sufficiently limit heat transfer during said selected shipment duration to approximately only that needed to maintain the first vessel in the frozen state during said selected shipment duration so as to prolong the refrigerant action of the prefrozen refrigerant material and minimize the refrigerant material needed;

a second tray removably positioned within said chest central compartment and having lower and upper faces and a wall of insulating material therebetween, said second tray operatively engaging and being supported by said first tray above said first tray in fixed position against downward travel within said chest central compartment during shipment and said second tray operatively engaging and holding said first tray in fixed position against upward travel within said chest central compartment during shipment, said second tray lower face being held in juxtaposition with said first tray upper face, said second tray upper face supporting the second vessel at a fixed distance above said refrigerant well, said second tray wall having a thickness of insulating material sized to sufficiently limit heat transfer therethrough to maintain the second vessel in an unfrozen state during said selected shipment duration, but to permit sufficient heat transfer to maintain said second vessel in a refrigerated state within a desired limited range of temperatures during said selected shipment duration; and an insulated lid removably positionable to close said chest open top and thereby close said chest interior space, said lid operatively engaging and holding said second tray in fixed position against upward travel within said chest central compartment during shipment, whereby packed within the same shipping container, the first vessel is maintained in a frozen state and the second vessel is maintained in an unfrozen state during shipment using a single supply of a pre-frozen refrigerant material in a predetermined amount, and the first and second vessels are held in stationary position within said chest as the refrigerant material changes shape or size within said refrigerant well.

2. The shipping container of claim 1 further including a storage member removably positioned within said chest central compartment between said chest lid and said second tray, and having a lower portion operatively engaging said second tray and an upper portion operatively engaging said chest lid with said chest lid applying force to said second tray through said storage member to hold said first and second trays in fixed position against upward travel within said chest central compartment during shipment, said storage member having four sidewalls and an end wall defining a closable, dry interior space with an open end, said storage member interior space being sized to receive written instruction materials or other items to be shipped with the first and second vessels but not requiring freezing or refrigeration, and having a storage member closure removably positionable to close said storage member open end and thereby close said storage member interior space.

3. The shipping container of claim 1 for safely shipping at least a third vessel being maintained in an unfrozen state during shipment, further including a third tray removably positioned within said chest central compartment between said second tray and said chest lid, and having lower and upper faces and a wall of insulating material therebetween, said third tray operatively engaging and being supported by said second tray above said second tray in fixed position against downward travel within said chest central compartment during shipment and said third tray operatively engaging said chest lid with said chest lid applying force to said second tray through said third tray to hold said first and second trays in fixed position against upward travel within said chest central compartment during shipment, said third tray lower face being held in juxtaposition with said second tray upper face, said third tray upper face supporting the third vessel at a fixed distance above said refrigerant well, said third tray wall having a thickness of insulating material sized to sufficiently limit heat transfer therethrough to maintain the third vessel in an unfrozen state during said selected shipment duration, but to permit sufficient heat transfer to maintain said third vessel in a refrigerated state within said desired range of temperatures at a higher temperature than the second vessel during said selected shipment duration.

4. The shipping container of claim 3 wherein said first tray upper face and said second tray lower face have correspondingly positioned indentations therein to together define a cavity sized to receive the first vessel and prevent lateral movement of the first vessel during shipment, and wherein said second tray upper face and said third tray lower face have correspondingly positioned indentations therein to together define a cavity sized to receive the second vessel and to prevent lateral movement of the second vessel during shipment.

5. The shipping container of claim 4 wherein said third tray upper face has an indentation therein sized to receive the third vessel and to prevent lateral movement of the third vessel during shipment.

6. The shipping container of claim 3 wherein one of said first tray upper face or said second tray lower face has a first perimeter recess and the other has a corresponding first perimeter projection portion sized and positioned to project into and fit snugly within said first perimeter recess to provide an interference fit locking said first and second trays together, and one of said second tray upper face or said third tray lower face has a second perimeter recess and the other has a corresponding second perimeter projection portion sized and positioned to project into and fit snugly within said second perimeter recess to provide an interference fit locking said second and third trays together.

7. The shipping container of claim wherein said first tray wall and said second tray wall have sufficient thicknesses of insulating material and said insulating material has sufficient shock absorbing capability to prevent breakage of the first and second vessels from normal shocks encountered during shipment.

8. The shipping container of claim 1 further including a carton sized to receive said first and second trays and hold said first and second trays together as a unit, said carton with said first and second trays therein being removably positioned within said chest central compartment, whereby at the termination of shipment said first and second trays can be removed from said chest in said carton as a unit for subsequent storage apart from said chest.

9. The shipping container of claim further including a shipping box sized to receive said chest with said lid in position closing said chest open top and holding said chest and said lid together as a unit during shipment.

10. The shipping container of claim wherein said first and second trays each have four sidewalls and are sized to fit snugly within said chest central compartment with said tray sidewalls in juxtaposition with corresponding ones of said four chest sidewalls to eliminate any free space therebetween and provide a thermal barrier to prevent any significant heat transfer between said first and second vessels and said refrigerant well through air space between said tray sidewalls and said chest sidewalls.

11. The shipping container of claim 1 wherein said chest sidewalls each have a thickness of insulating material sized to prevent any significant heat transfer between said first and second vessels and said refrigerant well through said chest sidewalls.

12. A shipping container for safely shipping at least two kits of vials, bottles and other vessels of material with each kit containing at least a first vessel to be maintained in a frozen state and at least a second vessel to be maintained in an unfrozen state during shipment using a pre-frozen refrigerant material, comprising:

an insulated chest with four sidewall bottom end wall of insulating material defining a closable interior space with an open top, said chest interior space having a central compartment sized to hold at least two kits positioned in side-by-side relation one adjacent to the other, and a refrigerant well immediately below said central compartment and spanning substantially the entire area under said central compartment, said refrigerant well being sized to receive a predetermined amount of the pre-frozen refrigerant material therein sufficient to maintain the first vessel of each kit in a frozen state for a selected shipment duration, said chest having a tray support within said chest interior space positioned at about an interface between said refrigerant well and said central compartment;

at least two kit containers each containing one kit separately packaged as a unit, said kit containers being removably positioned within said chest central compartment adjacent to the other and each supported by said support, each kit container comprising:

(a) a first tray removably positioned within said chest central compartment and having lower and upper faces and a wall of insulating material therebetween, said first tray being supported by said tray support to position said lower first tray face at said interface, immediately above said refrigerant well and the pre-frozen refrigerant material received therein, said tray support maintaining said first tray at a fixed position against downward travel toward said refrigerant well during shipment even should the pre-frozen refrigerant material melt, sublime or otherwise change state as heat is absorbed, and thereby change in shape or size, said first tray upper face supporting the first vessel at a fixed distance above said refrigerant well, said first tray wall having a thickness of insulating material sized to permit sufficient heat transfer therethrough to maintain the first vessel in a frozen state during said selected shipment duration, but to sufficiently limit heat transfer during said selected shipment duration to approximately only that needed to maintain the first vessel in the frozen state during said selected shipment duration so as to prolong the refrigerant action of the pre-frozen refrigerant material and minimize the refrigerant material needed;

(b) a second tray removably positioned within said chest central compartment and having lower and upper faces and a wall of insulating material therebetween, said second tray operatively engaging and being supported by said first tray above said first tray in fixed position against downward travel within said chest central compartment during shipment and said second tray operatively engaging and holding said first tray in fixed position against upward travel within said chest central compartment during shipment, said second tray lower face being held in juxtaposition with said first tray upper face, said second tray upper face supporting the second vessel at a fixed distance above said refrigerant well, said second tray wall having a thickness of insulating material sized to sufficiently limit heat transfer therethrough to maintain the second vessel in an unfrozen state during said selected shipment duration, but to permit sufficient heat transfer to maintain said second vessel in a refrigerated state within a desired limited range of temperatures during said selected shipment duration; and (c) means for holding said first and second of each kit together as a unit during shipment, and after removal from said chest, during subsequent storage apart from said chest; and an insulated lid removably positionable to close said chest open top and thereby close said chest interior space, said lid operatively engaging and holding said second tray of each kit container in fixed position against upward travel within said chest central compartment during shipment.

13. The shipping container of claim 12 further including a block of insulating material sized in outside dimension substantially equal to one of said kit containers for substitution therefor in said chest central compartment which would result from a missing one of said kit container and to prevent movement of the other of said kit containers being shipped when shipping the shipping container without one of said kit containers, whereby the same shipping container can be used to ship fewer than the total kit containers that said chest central compartment is sized to hold.

14. A shipping container for safely shipping at least two kits of vials, bottles and other vessels of material with each kit containing at least a first vessel to be maintained in a frozen state, at least a second vessel to be maintained in an unfrozen state during shipment using a pre-frozen refrigerant material and at least a third vessel being maintained in an unfrozen state during shipment and at a higher refrigerated temperature than the second vessel, comprising:

an insulated chest with four sidewalls and a bottom end wall of insulating material defining a closable interior space with an open top, said chest interior space having a central compartment sized to hold at least two kits positioned in side-by-side relation one adjacent to the other, and a refrigerant well immediately below said central compartment and spanning substantially the entire area under said central compartment, said refrigerant well being sized to receive a predetermined amount of the pre-frozen refrigerant material therein sufficient to maintain the first vessel of each kit in a frozen state for a selected shipment duration, said chest having a tray support within said chest interior space positioned at about an interface between said refrigerant well and said central compartment;

at least two kit containers each containing one kit separately packaged as a unit, said kit containers being removably positioned within said chest central compartment adjacent to the other and each supported by said support, each kit container comprising:

(a) a first tray removably positioned within said chest central compartment and having lower and upper faces and a wall of insulating material therebetween, said first tray being supported by said tray support to position said lower first tray face at said interface, immediately above said refrigerant well and the pre-frozen refrigerant material received therein, said tray support maintaining said first tray at a fixed position against downward travel toward said refrigerant well during shipment even should the pre-frozen refrigerant material melt, sublime or otherwise change state as heat is absorbed, and thereby change in shape or size, said first tray upper face supporting the first vessel at a fixed distance above said refrigerant well, said first tray wall having a thickness of insulating material sized to permit sufficient heat transfer therethrough to maintain the first vessel in a frozen state during said selected shipment duration, but to sufficiently limit heat transfer during said selected shipment duration to approximately only that needed to maintain the first vessel in the frozen state during said selected shipment duration so as to prolong the refrigerant action of the prefrozen refrigerant material and minimize the refrigerant material needed;

(b) a second tray removably positioned within said chest central compartment and having lower and upper faces and a wall of insulating material therebetween, said second tray operatively engaging and being supported by said first tray above said first tray in fixed position against downward travel within said chest central compartment during shipment and said second tray operatively engaging and holding said first tray in fixed position against upward travel within said chest central compartment during shipment, said second tray lower face being held in juxtaposition with said first tray upper face, said second tray upper face supporting the second vessel at a fixed distance above said refrigerant well, said second tray wall having a thickness of insulating material sized to sufficiently limit heat transfer therethrough to maintain the second vessel in an unfrozen state during said selected shipment duration, but to permit sufficient heat transfer to maintain said second vessel in a refrigerated state within a desired limited range of temperatures during said selected shipment duration;

(c) a third tray removably positioned within said chest central compartment, and having lower and upper faces and a wall of insulating material therebetween, said third tray operatively engaging and being supported by said second tray above said second tray in fixed position against downward travel within said chest central compartment during shipment and said third tray operatively engaging and holding said second tray, and thereby holding said first tray, in fixed position against upward travel within said chest central compartment during shipment, said third tray lower face being held in juxtaposition with said second tray upper face, said third tray upper face supporting the third vessel at a fixed distance above said refrigerant well, said third tray wall having a thickness of insulating material sized to sufficiently limit heat transfer therethrough to maintain the third vessel in an unfrozen state during said selected shipment duration, but to permit sufficient heat transfer to maintain said third vessel in a refrigerated state within said desired range of temperatures during said selected shipment duration; and (d) means for holding said first and second trays of each kit together as a unit during shipment and after removal from said chest, during subsequent storage apart from said chest; and an insulated lid removably positionable to close said chest open top and thereby close said chest interior space, said lid operatively engaging and holding said second tray of each kit container in fixed position against upward travel within said chest central compartment during shipment.

15. The shipping container of claim 14 further including a storage member removably positioned within said chest central compartment between said chest lid and said third tray, and having a lower portion operatively engaging said third tray and an upper portion operatively engaging said chest lid with said chest lid applying force to said third tray through said storage member to hold said first, second and third trays in fixed position against upward travel within said chest central compartment during shipment, said storage member having four sidewalls and an end wall defining a closable, dry interior space with an open end, said storage member interior space being sized to receive written instruction materials or other items to be shipped with the first, second and third vessels but not requiring freezing or refrigeration, and having a storage member closure removably positionable to close said storage member open end and thereby close said storage member interior space.

16. The shipping container of claim 14 wherein said first, second and third trays each have four sidewalls and are sized to fit snugly within said chest central compartment with said tray sidewalls in juxtaposition with corresponding ones of said four chest sidewalls to eliminate any free space therebetween and provide a thermal barrier to prevent any significant heat transfer between said first, second and third vessels and said refrigerant well through air space between said tray sidewalls and said chest sidewalls.

17. A shipping container for safely shipping vials, bottles and other vessels of material with at least a first vessel to be maintained in a frozen state, at least a second vessel to be maintained in an unfrozen state during shipment using a pre-frozen refrigerant material, and at least a third vessel being maintained in an unfrozen state during shipment and at a higher refrigerated temperature than the second vessel, comprising:

an insulated chest with four sidewalls and a bottom end wall of insulating material defining a closable interior space with an open top, said chest interior space having a central compartment and a refrigerant well immediately below said central compartment, said refrigerant well being sized to receive a predetermined amount of the pre-frozen refrigerant material therein sufficient to maintain the first vessel in a frozen state for a selected shipment duration, said chest having a tray support shoulder within said chest interior space positioned at about an interface between said refrigerant well and said central compartment;

a first tray removably positioned within said chest central compartment and having lower and upper faces and a wall of insulating material therebetween, said first tray being supported by said tray support shoulder to position said lower first tray face at said interface, immediately above said refrigerant well and the pre-frozen refrigerant material received therein, said tray support shoulder maintaining said first tray at a fixed position against downward travel toward said refrigerant well during shipment even should the pre-frozen refrigerant material melt, sublime or otherwise change state as heat is absorbed, and thereby change in shape or size, said first tray upper face supporting the first vessel at a fixed distance above said refrigerant well, said first tray wall having a thickness of insulating material sized to permit sufficient heat transfer therethrough to maintain the first vessel in a frozen state during said selected shipment duration, but to sufficiently limit heat transfer during said selected shipment duration to approximately only that needed to maintain the first vessel in the frozen state during said selected shipment duration so as to prolong the refrigerant action of the pre-frozen refrigerant material and minimize the refrigerant material needed;

a second tray removably positioned within said chest central compartment and having lower and upper faces and a wall of insulating material therebetween, said second tray operatively engaging and being supported by said first tray above said first tray in fixed position against downward travel within said chest central compartment during shipment and said second tray operatively engaging and holding said first tray in fixed position against upward travel within said chest central compartment during shipment, said second tray lower face being held in juxtaposition with said first tray upper face, said second tray upper face supporting the second vessel at a fixed distance above said refrigerant well, said second tray wall having a thickness of insulating material sized to sufficiently limit heat transfer therethrough to maintain the second vessel in an unfrozen state during said selected shipment duration, but to permit sufficient heat transfer to maintain said second vessel in a refrigerated state within a desired limited range of temperatures during said selected shipment duration;

a third tray removably positioned within said chest central compartment, and having lower and upper faces and a wall of insulating material therebetween, said third tray operatively engaging and being supported by said second tray above said second tray in fixed position against downward travel within said chest central compartment during shipment and said third tray operatively engaging and holding said second tray, and thereby holding said first tray, in fixed position against upward travel within said chest central compartment during shipment, said third tray lower face being held in juxtaposition with said second tray upper face, said third tray upper face supporting the third vessel at a fixed distance above said refrigerant well, said third tray wall having a thickness of insulating material sized to sufficiently limit heat transfer therethrough to maintain the third vessel in an unfrozen state during said selected shipment duration, but to permit sufficient heat transfer to maintain said third vessel in a refrigerated state within said desired range of temperatures during said selected shipment duration; and an insulated lid removably positionable to close said chest open top and thereby close said chest interior space, said lid operatively engaging and holding said third tray in fixed position against upward travel within said chest central compartment during shipment, whereby packed within the same shipping container, the first vessel is maintained in a frozen state and the second and third vessels are maintained in an unfrozen state during shipment using a single supply of a pre-frozen refrigerant material in a predetermined amount, and the first, second and second vessels are held in stationary position within said chest as the refrigerant material changes shape or size within said refrigerant well.

18. The shipping container of claim 17 further including a storage member removably positioned within said chest central compartment between said chest lid and said third tray, and having a lower portion operatively engaging said third tray and an upper portion operatively engaging said chest lid with said chest lid applying force to said third tray through said storage member to hold said first, second and third trays in fixed position against upward travel within said chest central compartment during shipment, said storage member having four sidewalls and an end wall defining a closable, dry interior space with an open end, said storage member interior space being sized to receive written instruction materials or other items to be shipped with the first, second and third vessels but not requiring freezing or refrigeration, and having a storage member closure removably positionable to close said storage member open end and thereby close said storage member interior space.

19. The shipping container of claim 17 wherein said first tray upper face and said second tray lower face have correspondingly positioned indentations therein to together define a cavity sized to receive the first vessel and prevent lateral movement of the first vessel during shipment, and wherein said second tray upper face and said third tray lower face have correspondingly positioned indentations therein to together define a cavity sized to receive the second vessel and to prevent lateral movement of the second vessel during shipment, and wherein said third tray upper face has an indentation therein sized to receive the third vessel and to prevent lateral movement of the third vessel during shipment.

20. The shipping container of claim 17 wherein said first, second and third tray walls have sufficient thicknesses of insulating material and said insulating material has sufficient shock absorbing capability to prevent breakage of the first, second and third vessels from normal shocks encountered during shipment.

21. The shipping container of claim 17 further including a carton sized to receive said first, second and third trays and hold said first, second and third trays together as a unit, said carton with said first, second and third trays therein being removably positioned within said chest central compartment, whereby at the termination of shipment said first, second and third trays can be removed from said chest in said carton as a unit for subsequent storage apart from said chest.

22. The shipping container of claim 17 wherein said first, second and third trays each have four sidewalls and are sized to fit snugly within said chest central compartment with said tray sidewalls in juxtaposition with corresponding ones of said four chest sidewalls to eliminate any free space therebetween and provide a thermal barrier to prevent any significant heat transfer between said first, second and third vessels and said refrigerant well through air space between said tray sidewalls and said chest sidewalls.

23. The shipping container of claim 17 wherein said chest sidewalls each have a thickness of insulating material sized to prevent any significant heat transfer between said first, second and third vessels and said refrigerant well through said chest sidewalls.

24. The shipping container of claim 17 wherein said selected shipment duration is at least 72 hours.

* * * * *

UNITED STATES PATENT AND TRADEMARK OFFICE

CERTIFICATE OF CORRECTION

PATENT NO. : 4,947,658

DATED : August 14, 1990

INVENTOR(S) : Wheeler et al.

It is certified that error appears in the above-identified patent and that said Letters Patent is hereby corrected as shown below:

In column 11, line 67 [claim 7], before "wherein" and after "claim" please insert --1--.

In column 12, line 14 [claim 9], before "further" and after "claim" please insert --1--.

In column 12, line 18 [claim 10], before "wherein" and after "claim" please insert --1--.

In column 12, line 39 [claim 12], please change "sidewall" to --sidewalls--.

In column 13, line 41 [claim 12], before "of" and after "second" please insert --trays--.

In column 17, line 35 [claim 17], after "and" and before "vessels" please delete "second" and insert --third-- therefor.

Signed and Sealed this

Fifth Day of December, 1995

*Attest:*

Bruce Lehman

BRUCE LEHMAN

*Attesting Officer*

*Commissioner of Patents and Trademarks*